US008281475B2

(12) United States Patent
Cabanski et al.

(10) Patent No.: US 8,281,475 B2
(45) Date of Patent: Oct. 9, 2012

(54) SHEET METAL JOINT

(75) Inventors: John L. Cabanski, Mount Prospect, IL (US); Thomas O. Zurfluh, Evanston, IL (US)

(73) Assignee: Federal-Mogul World Wide, Inc., Southfield, MI (US)

( * ) Notice: Subject to any disclaimer, the term of this patent is extended or adjusted under 35 U.S.C. 154(b) by 469 days.

(21) Appl. No.: 12/573,372

(22) Filed: Oct. 5, 2009

(65) Prior Publication Data

US 2011/0079065 A1 Apr. 7, 2011

(51) Int. Cl.
*B21D 39/00* (2006.01)
*B21B 41/00* (2006.01)

(52) U.S. Cl. ..... 29/513; 72/203

(58) Field of Classification Search ..... 29/505, 29/513, 509, 432, 432.1, 433, 428, 439, 521; 72/203, 186, 324; 52/791.1, 783.1; 428/594, 428/597, 598, 329
See application file for complete search history.

(56) References Cited

U.S. PATENT DOCUMENTS

| | | | |
|---|---|---|---|
| 45,536 | A | 12/1864 | Terwilliger et al. |
| 184,397 | A | 11/1876 | Macumber |
| 384,118 | A | 6/1888 | Bellinger |
| 430,000 | A | 6/1890 | Clark et al. |
| 518,767 | A | 4/1894 | Plecker |
| 548,483 | A | 10/1895 | Vogel |
| 767,798 | A | 8/1904 | Clark |
| 804,799 | A | 11/1905 | Edison |
| 945,682 | A | 1/1910 | Berg |
| 1,296,272 | A | 3/1919 | Doble |
| 1,352,656 | A | 9/1920 | Cahill |
| 1,368,490 | A | 2/1921 | Dieckmann |
| 1,496,961 | A | 6/1924 | Welsch et al. |
| 1,650,518 | A | 11/1927 | Humphris |
| 1,652,331 | A | 12/1927 | Sebell |
| 1,968,365 | A | 7/1934 | Bailey |
| 1,980,154 | A | 11/1934 | Coe |
| 1,997,987 | A | 4/1935 | Victor, Jr. |
| 2,023,059 | A | 12/1935 | Storey |
| 2,024,369 | A | 12/1935 | Kaiser |
| 2,173,730 | A | 9/1939 | Schmied |
| 2,321,755 | A | 6/1943 | Kost |
| 2,359,205 | A | 9/1944 | Michael |
| 2,426,670 | A | 9/1947 | Cooley |
| 2,625,723 | A | 1/1953 | Bassett |
| 2,663,072 | A | 12/1953 | Pfistershammer |
| 2,702,103 | A | 2/1955 | Pfistershammer |
| 2,733,177 | A | 1/1956 | Meyer |
| 2,754,581 | A | 7/1956 | Thomas |

(Continued)

FOREIGN PATENT DOCUMENTS

| | | |
|---|---|---|
| DE | 39 33 765 | 4/1991 |

(Continued)

*Primary Examiner* — John C Hong
(74) *Attorney, Agent, or Firm* — Robert L. Stearns; Dickinson Wright, PLLC

(57) ABSTRACT

The invention provides a sheet metal joint and a method for forming a sheet metal joint. The sheet metal joint includes first and second metal sheets disposed in parallel relation to one another. Each of the first and second metal sheets has a plurality of perforations with a tang extending from each perforation. The tangs of the second sheet and the tangs of the second metal sheet are curled together in opposite rotational directions. The tangs of the first metal sheet space the first and second metal sheets from one another and the tangs of the second metal sheet substantially fixedly engage the first and second metal sheets with respect to one another.

3 Claims, 3 Drawing Sheets

U.S. PATENT DOCUMENTS

| | | | | |
|---|---|---|---|---|
| 2,772,757 | A | 12/1956 | Hammond | |
| 2,812,813 | A | 11/1957 | Zarnowski | |
| 2,901,816 | A | 9/1959 | Smith et al. | |
| 2,912,075 | A | 11/1959 | Pfistershammer | |
| 2,916,181 | A | 12/1959 | Pfister et al. | |
| 3,008,551 | A | 11/1961 | Cole | |
| 3,010,199 | A | 11/1961 | Smith et al. | |
| 3,082,850 | A | 3/1963 | Weening | |
| 3,083,773 | A | 4/1963 | Nagel et al. | |
| 3,210,815 | A | 10/1965 | Breuning | |
| 3,376,684 | A | 4/1968 | Cole et al. | |
| 3,462,805 | A | 8/1969 | Quisling | |
| 3,465,414 | A | 9/1969 | Koett | |
| 3,517,589 | A | 6/1970 | Helmut et al. | |
| 3,728,881 | A | 4/1973 | Coop | |
| 3,793,791 | A | 2/1974 | Wootten | |
| 3,824,757 | A | 7/1974 | Coop | |
| 3,846,218 | A | 11/1974 | Wootten | |
| 3,924,378 | A | 12/1975 | Hafner | |
| 3,953,634 | A | 4/1976 | Wootten | |
| 3,999,924 | A | 12/1976 | Tanaka | |
| 4,039,708 | A | 8/1977 | Okada | |
| 4,226,007 | A | 10/1980 | Duenser | |
| 4,279,066 | A | 7/1981 | Riley | |
| 4,599,771 | A | 7/1986 | Trenkler et al. | |
| 4,679,367 | A | 7/1987 | Geisthardt | |
| 4,776,602 | A | 10/1988 | Gallo | |
| 4,805,592 | A | 2/1989 | Enami | |
| 4,911,972 | A | 3/1990 | Mercuri | |
| 5,172,920 | A | 12/1992 | Schlenk | |
| 5,656,353 | A | 8/1997 | Butler | |
| 5,672,405 | A | 9/1997 | Plank et al. | |
| 5,678,946 | A | 10/1997 | Enami | |
| 6,209,202 | B1 | 4/2001 | Rhodes et al. | |
| 6,258,431 | B1 | 7/2001 | Reis et al. | |
| 6,268,037 | B1 | 7/2001 | Butler et al. | |
| 6,314,633 | B1 | 11/2001 | Norkus et al. | |
| 7,374,810 | B2 | 5/2008 | Durney et al. | |
| 7,614,201 | B2 * | 11/2009 | Cabanski et al. | 52/791.1 |
| 2002/0109422 | A1 | 8/2002 | Hatton | |
| 2004/0012178 | A1 | 1/2004 | Wisniewski | |
| 2005/0044915 | A1 | 3/2005 | Shimizu et al. | |
| 2007/0094983 | A1 * | 5/2007 | Cabanski et al. | 52/580 |

FOREIGN PATENT DOCUMENTS

| | | | |
|---|---|---|---|
| JP | 322819 | | 5/1957 |
| JP | 55126112 | A | 9/1980 |
| JP | 57190737 | | 11/1982 |
| JP | 57190738 | | 11/1982 |
| JP | 58070326 | U | 5/1983 |

* cited by examiner

SHEET METAL JOINT

This application claims priority to U.S. application Ser. No. 11/242,692, filed Oct. 4, 2005, and is incorporated herein by reference.

BACKGROUND OF THE INVENTION

1. Field of the Invention

The invention relates to sheet metal joint and a method of joining at least two metal sheets.

2. Description of Related Art

The construction of a joint between metal sheets can be accomplished by overlapping and folding the ends of the sheets. Alternatively, the sheets can be formed with tangs that are folded over one another. This type of joint is disclosed in U.S. Pat. No. 3,824,757. Alternatively, the sheets can be formed with holes that are aligned and then folded over one another. This type of joint is disclosed in U.S. Pat. No. 3,082,850.

SUMMARY OF THE INVENTION

The invention provides a sheet metal joint and a method for forming a sheet metal joint. The sheet metal joint includes first and second metal sheets disposed in parallel relation to one another. Each of the first and second metal sheets has a plurality of perforations with a tang extending from each perforation. The tangs of the first sheet and the tangs of the second metal sheet are curled together in opposite rotational directions. The tangs of the first metal sheet space the first and second metal sheets from one another and the tangs of the second metal sheet substantially fixedly engage the first and second metal sheets with respect to one another.

BRIEF DESCRIPTION OF THE DRAWINGS

Advantages of the present invention will become more readily appreciated when considered in connection with the following detailed description and appended drawings, wherein.

DETAILED DESCRIPTION OF THE PREFERRED EMBODIMENT

Figure 1:
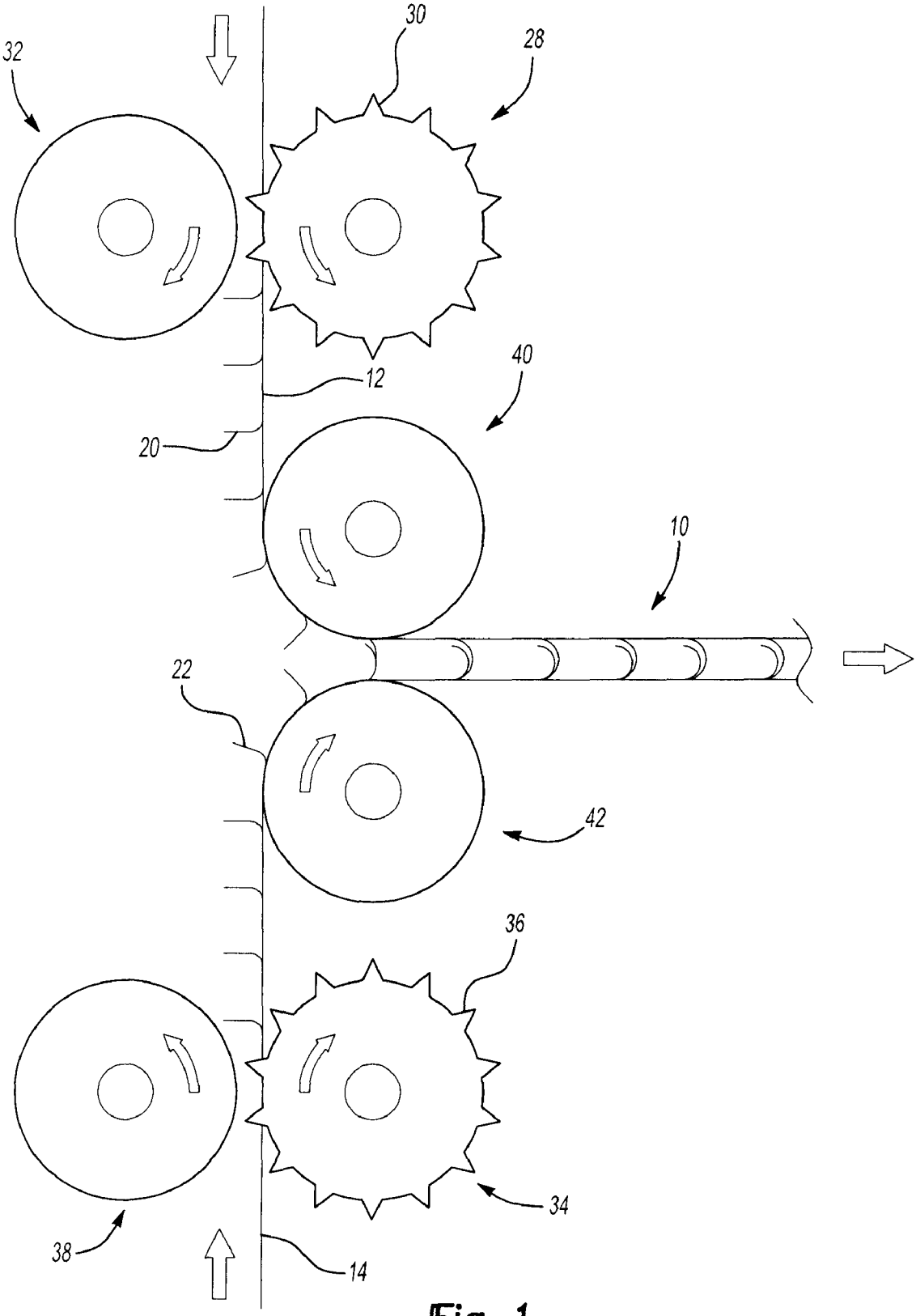
FIG. 1 is a schematic side view of an arrangement for forming a sheet metal joint according to an exemplary embodiment of the invention.

A plurality of different embodiments of the invention are shown in the Figures of the application. Similar features are shown in the various embodiments of the invention. Similar features have been numbered with a common two-digit reference numeral and have been differentiated by a third digit placed before the two common digits. Also, to enhance consistency, features in any particular drawing share the same two digit designation even if the feature is shown in less than all embodiments. Similar features are structured similarly, operate similarly, and/or have the same function unless otherwise indicated by the drawings or this specification. Furthermore, particular features of one embodiment can replace corresponding features in another embodiment unless otherwise indicated by the drawings or this specification.

Figure 2:
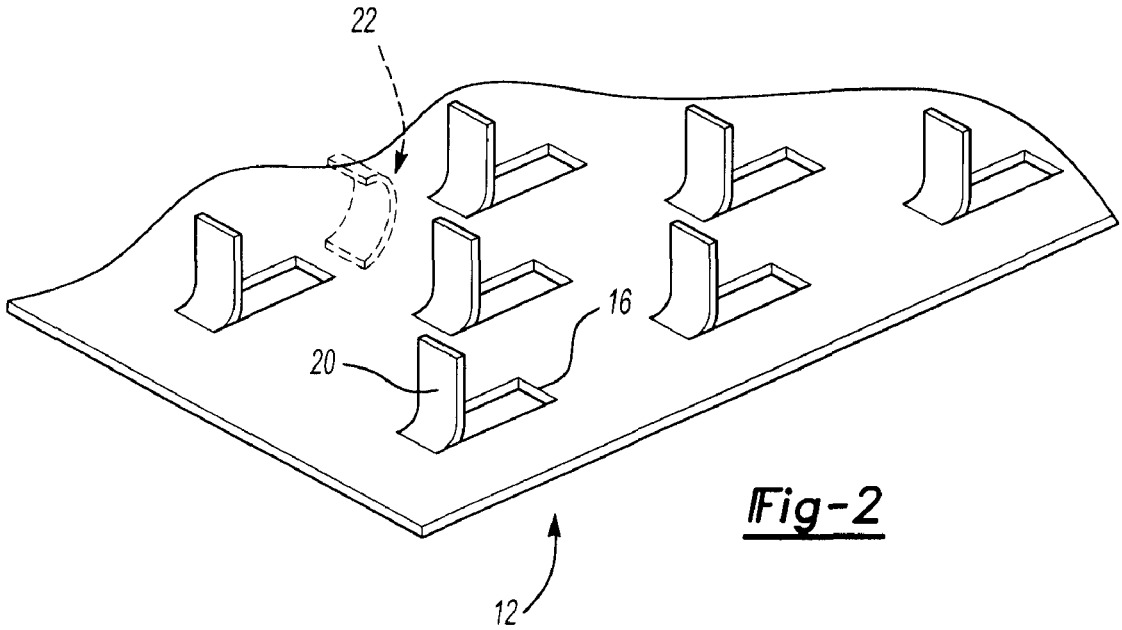
FIG. 2 is a perspective view of a sheet having perforations according to an exemplary embodiment of the invention.
Figure 3:
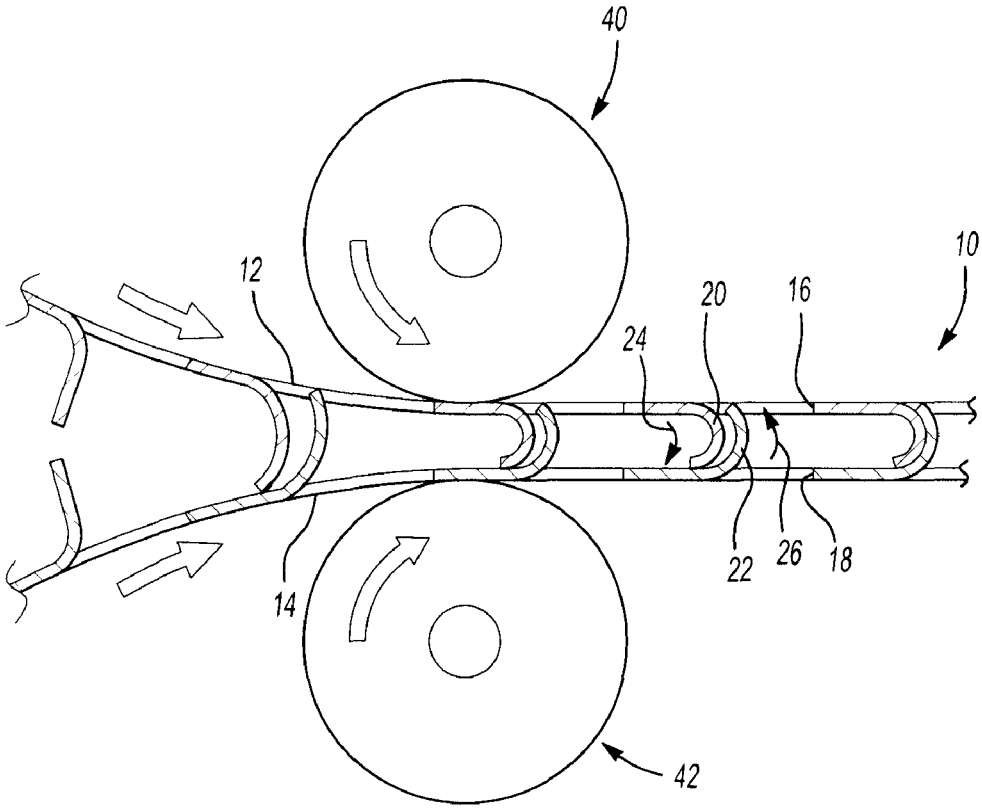
FIG. 3 is a schematic side view of an arrangement for engaging two metal sheets according to an exemplary embodiment of the invention.

The invention provides a sheet metal joint 10 and a method for forming a sheet metal joint 10. Referring to FIGS. 1-3, the sheet metal joint 10 includes first and second metal sheets 12, 14 disposed in parallel relation to one another. Each of the first and second metal sheets 12, 14 has a plurality of perforations 16, 18, respectively, with a tang 20, 22 extending from each perforation 16, 18. The tangs 22 of the first metal sheet 12 and the tangs 22 of the second metal sheet 14 are curled together in opposite rotational directions 24, 26. The tangs 22 of the first metal sheet 12 space the first and second metal sheets 12, 14 from one another and the tangs 22 of the second metal sheet 14 substantially fixedly engage the first and second metal sheets 12, 14 with respect to one another.

In an exemplary embodiment of the invention, the tangs 22 of the second metal sheet 14 could extend around the tangs 20 of first metal sheet 12 and through the perforations 16 of the first metal sheet. Also, the tangs 22 of the second metal sheet 14 could be wider than the perforations 16 of the first metal sheet 12. In such an embodiment of the invention, the tangs 22 of the second metal sheet 14 (shown in phantom in FIG. 2) would be deformed for insertion into the perforations 16 of the first metal sheet 12.

It is noted that either the tangs 22 of the second metal sheet 14 can circle the tangs 20 of the first metal sheet 12, as shown in FIG. 3, or the tangs 20 of the first metal sheet 12 can circle the tangs 22 of the second metal sheet 14, as shown in FIG. 1.

FIGS. 1 and 3 show schematic side views of structure for forming the first exemplary embodiment of the sheet metal joint 10. The first metal sheet 12 is directed between a first roller 28 having a plurality of punches 30 and a second roller 32 having a plurality of recesses (not visible) to receive the punches 30. The perforations 16 and tangs 20 are formed by the cooperation between the rollers 28, 32. The second metal sheet 14 is directed between a first roller 34 having a plurality of punches 36 and a second roller 38 having a plurality of recesses (not visible) to receive the punches 36. The perforations 18 and tangs 22 are formed by the cooperation between the rollers 34, 38.

The first and second metal sheets 12, 14 are moved past the rollers 28, 32, 34, 38 to rollers 40, 42. The first metal sheet 12 is moved around the roller 40 with the tangs 20 extending away from the roller 40. The second metal sheet 14 is moved around the roller 42 with the tangs 22 extending away from the roller 42. FIGS. 1 and 3 show slightly different embodiments of structure for practicing the invention wherein, for example, FIG. 1 shows the sheets 12, 14 being directed along a ninety degree change of direction by the rollers 40 and 42 while FIG. 3 shows the sheets 12, 14 being directed along less than a ninety degree change of direction by the rollers 40 and 42. The rollers 40, 42 are spaced from one another such that the tangs 20 of the first metal sheet 12 and the tangs 22 of the second metal sheet 14 are overlapped and bent around one another during movement between the rollers 40, 42. Movement of the sheets 12, 14 and the rollers 28, 32, 34, 38 can be controlled by a controller so that the tangs 20 are properly aligned and received the tangs 22 prior to curling of the tangs 20, 22 between the rollers 40, 42.

Figure 4:
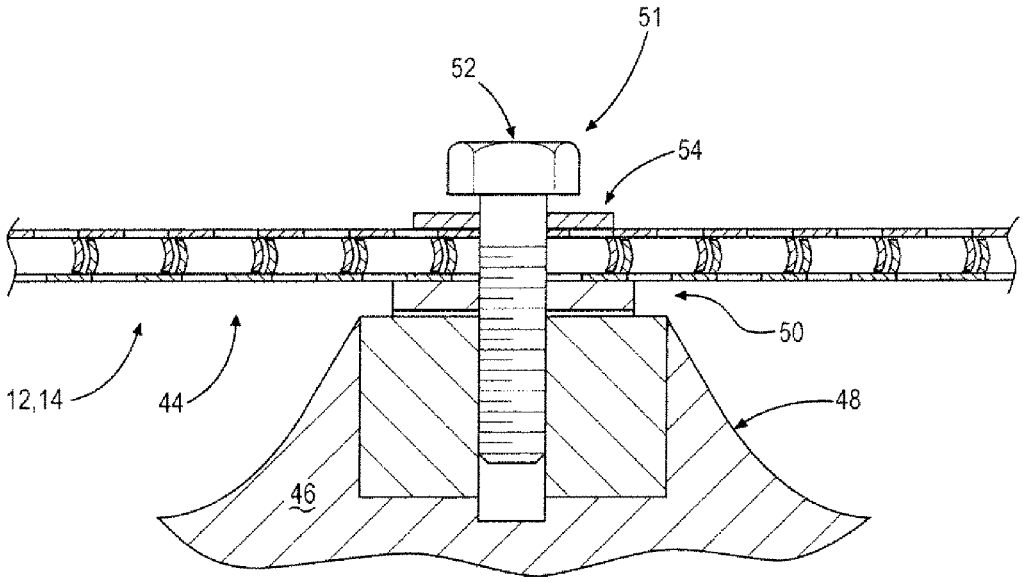
FIG. 4 is a schematic side view of a two metal sheets joined to one another in an exemplary operating environment.

FIG. 4 shows an exemplary operating environment for the joined, first and second metal sheets 12, 14. The joined, first and second metal sheets 12, 14 cooperate to define a heat shield 44. A hot component 46, such as an engine block or manifold, defines a boss 48. An isolator 50 is disposed between the heat shield 44 and the boss 48. A bolt 51 having a bolt head 52 is threadingly received in the boss 48 to fix the heat shield 44 with respect to the component 46. A washer 54 can be disposed between the heat shield 44 and the bolt head 52.

Figure 5:
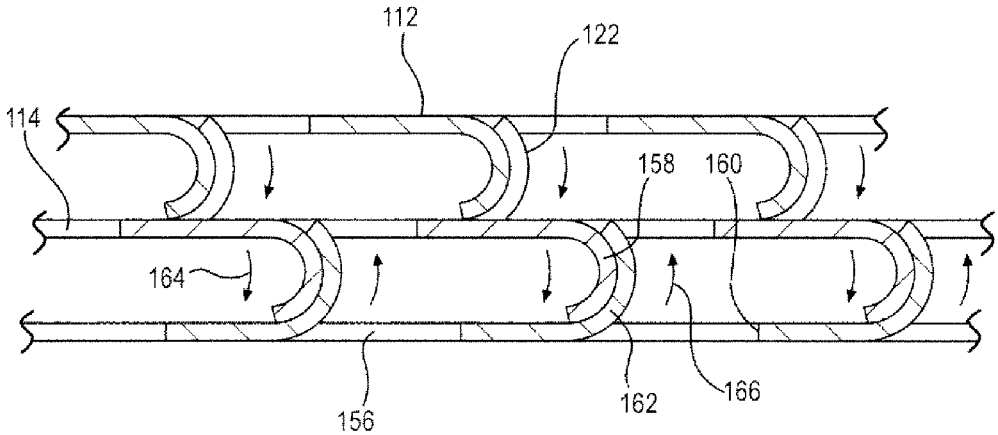
FIG. 5 is side view of an exemplary embodiment of the invention wherein three metal sheets are engaged with one another.

FIG. 5 shows another exemplary embodiment of the invention where three sheets 112, 114, 156 are engaged with one another. The second metal sheet 114 includes a first set of tangs 122 extending toward the first metal sheet 112 and a second set of tangs 158 extending away from the first metal sheet 112. A third metal sheet 156 is disposed in parallel relation with the first and second metal sheets 112, 114. The third metal sheet 156 includes a plurality of perforations 160 with a tang 162 extending from each perforation 160. The second set of tangs 158 of the second sheet 114 and the tangs 162 of the third metal sheet 156 are curled together in opposite rotational directions 164, 166. The second set of tangs 158 of the second metal sheet 114 space the second and third metal sheets 114, 156 from one another and the tangs 162 of the third metal sheet 156 substantially fixedly engage the second and third metal sheets 114, 156 with respect to one another.

In the embodiments of the application shown in the drawings, all the tangs of one sheet surrounded by the tangs of a second sheet. However, in alternative embodiments of the invention, alternating tangs of a first sheet could be surrounded by corresponding, alternating tangs of a second sheet and vice-versa. This could be done by adjusting the geometry of the perforating rollers.

Obviously, many modifications and variations of the present invention are possible in light of the above teachings. It is, therefore, to be understood that within the scope of the appended claims, the invention may be practiced otherwise than as specifically described.

What is claimed is:

1. A method for forming a sheet metal joint comprising the steps of:

punching a plurality of perforations in first and second metal sheets with a tang extending from each of the perforations;

disposing the first and second metal sheets in parallel relation; and curling the tangs of the first metal sheet and the tangs of the second metal sheet together in opposite rotational directions.

2. The method of claim 1 wherein said punching step includes the step of:

directing the first and second metal sheets individually between a first roller having a plurality of punches and a second roller having a plurality of recesses to receive the punches.

3. The method of claim I wherein said curling step includes the steps of:

moving the first metal sheet around a third roller with the tangs extending away from the third roller;

moving the second metal sheet around a fourth roller with the tangs extending away from the fourth roller;

spacing the third and fourth rollers from one another such that the tangs of the first metal sheet and the tangs of the second metal sheet are overlapped and bent around one another during movement between the third and fourth rollers.

* * * * *